United States Patent [19]

Nusbaumer et al.

[11] 4,119,017

[45] Oct. 10, 1978

[54] NON-ROTATABLE FLUID POWER CYLINDER

[75] Inventors: Kay T. Nusbaumer; Peter W. Boyer, both of Fort Wayne, Ind.

[73] Assignee: PHD, Inc., Fort Wayne, Ind.

[21] Appl. No.: 780,666

[22] Filed: Mar. 23, 1977

[51] Int. Cl.[2] ..... F01B 31/00

[52] U.S. Cl. ..... 92/108; 92/113; 92/165 PR

[58] Field of Search ..... 92/108, 113, 165 R, 92/165 PR

[56] References Cited

U.S. PATENT DOCUMENTS

| | | | |
|---|---|---|---|
| 2,262,963 | 11/1941 | Procissi | 92/113 X |
| 2,550,601 | 4/1951 | Rosenberg | 92/165 |
| 2,986,122 | 5/1961 | Shattuck | 92/113 |
| 3,030,935 | 4/1962 | Hanes | 92/113 X |
| 3,152,522 | 10/1964 | Burden et al. | 92/108 X |

FOREIGN PATENT DOCUMENTS

| | | | |
|---|---|---|---|
| 2,521,364 | 11/1976 | Fed. Rep. of Germany | 92/165 PR |

*Primary Examiner*—Irwin C. Cohen

*Attorney, Agent, or Firm*—Gust, Irish, Jeffers & Rickert

[57] ABSTRACT

A fluid power cylinder comprising a cylinder barrel, a guide rod received within the cylinder barrel and a piston slidably received within the cylinder barrel over the guide rod for rectilinear movement, means for slidably keying the piston to the guide rod whereby the piston is locked against rotation with respect to the guide rod about the longitudinal axis thereof, a guide rod holder rotatably received in the end cap for rotation coaxially with the piston and the guide rod, a pin connecting the guide rod and guide rod holder so that the guide rod is locked against rotation with respect to the holder about its longitudinal axis yet is permitted a limited degree of tilting about the end received in the guide rod holder, and a cam lock associated with the end cap for releasably clamping the guide rod holder against rotation.

17 Claims, 4 Drawing Figures

NON-ROTATABLE FLUID POWER CYLINDER

BACKGROUND OF THE INVENTION

Field of the Invention

This invention relates to reciprocating fluid power cylinders of the hydraulic or pneumatic type wherein it is desirable to prevent relative rotation between the piston and the cylinder.

In a variety of mechanical systems utilizing a hydraulic or pneumatic piston of a power cylinder to achieve reciprocal motion, for example, machine tools, fluid actuated controls for aircraft and other vehicles, and pumps, it is often desirable to prevent relative rotation between the piston rod and the cylinder barrel.

A first example of a prior art device of this type wherein relative rotation between the piston rod and cylinder barrel is prevented employs a non-circular guide rod having a square or splined configuration, for example, over which the piston and piston rod slide. In order to prevent this assembly from rotating relative to the cylinder barrel, the non-circular guide rod is rigidly fastened to the cylinder barrel or cylinder end cap by means of a threaded connection, cooperating internal and external splines, or a locking pin which can be indexed to various positions about the axis of the cylinder barrel. A difficulty with this type of prior art device is that angular adjustments are made difficult due to the necessity for axial tightening of the guide rod in the case of a threaded connection, and the fact that adjustment can only be made by an integral number of teeth in the case of a splined connected or an indexable pin. Another problem with this type of device is that if there is any angularity in the connection between the guide rod and end cap, the piston will be forced off to one side so that it binds as it reciprocates.

In another prior art device, the splined guide rod is drawn down into a cap made of a soft material which prevents it from rotating about its axis. The splines make slight indentations inside the cap, however, and if an angular adjustment is attempted which is not an integral number of teeth, the spline tends to fall back into one of the ridges which it had previously formed in the cap.

A further type of prior art fluid power cylinder having a non-rotating feature employs a plurality of auxiliary guide rods which extend parallel to the center guide rod. The drawback to this design is that it requires the use of additional seals to prevent fluid leakage from the cylinder. Furthermore, the presence of the auxiliary shafts reduces the working area of the piston.

Another prior art example of non-rotating fluid cylinders employs a piston rod having a non-circular configuration with one or more flat sides slidably engaging complementary flat surfaces in the bearing for the piston rod. The flat surfaces are difficult to seal, however, so that fluid leakage becomes a problem.

SUMMARY OF THE INVENTION

The present invention overcomes the aforementioned disadvantages of the prior art devices in that the connection between the splined or otherwise keyed guide rod and the end cap permits a limited degree of tilting thereby compensating for manufacturing irregularities and permitting greater tolerances between cooperating elements. Furthermore, the piston and piston rod may be adjusted angularly by virtue of a cam lock acting on the guide rod holder.

This is accomplished by the present invention which comprises a cylinder barrel, an end cap enclosing one end of the cylinder barrel, a guide rod received within the cylinder barrel, a piston slidably received within the cylinder barrel over the guide rod for rectilinear movement, means for slidably keying the piston to the guide rod whereby the piston is locked against rotation with respect to the guide rod about its longitudinal axis, a guide rod holder rotatably received in the end cap for rotation coaxially with the piston and the guide rod, means for connecting the guide rod and guide rod holder so that the guide rod is locked against rotation relative to the guide rod holder, and lock means associated with the end cap for releasably clamping the guide rod holder against rotation. The connection between the guide rod and the guide rod holder includes means for permitting the guide rod to tilt to a limited degree about any axis perpendicular to the longitudinal axis of the guide rod.

It is an object of the present invention to provide a fluid power cylinder wherein the piston is prevented from rotating relative to the cylinder barrel yet is capable of being adjusted angularly and locked at any desired position.

It is also an object of the present invention to provide a fluid power cylinder wherein the effective working area of the piston is not reduced by the rotation preventing means.

A further object of the present invention is to provide a fluid power cylinder of the non-rotating type wherein a certain degree of play between the piston guide rod and cylinder barrel is permitted so that tolerances may be increased thereby reducing manufacturing costs.

It is yet another object to provide for the rotational adjustment of the piston in a cylinder barrel without disrupting the sealed condition of the piston chambers within the cylinder barrel.

Another object of the present invention is to provide a fluid power cylinder which is simple in construction and economical to manufacture.

These and other objects will be apparent from the following description of the preferred embodiment.

DESCRIPTION OF THE PREFERRED EMBODIMENT

Figure 1:
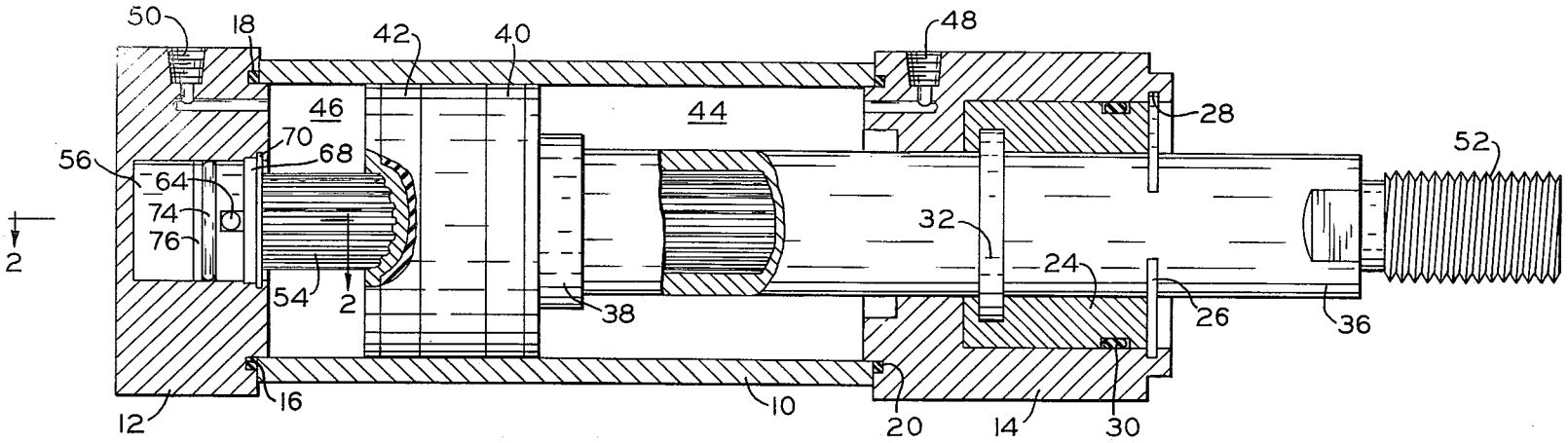
FIG. 1 is a longitudinal sectional view of the preferred embodiment of the present invention.

Referring to the drawings, 10 represents a cylinder which may be made of steel, aluminum or other suitable material, having first and second end caps 12 and 14 secured to and closing opposite ends of cylinder 10. End cap 12 is provided with an annular groove 16 in which is disposed a suitable seal such as a rubber or plastic O-ring 18. End cap 14 has a similar annular groove 20 in which is disposed an O-ring 22 which, like O-ring 18, is for the purpose of sealing the interior of cylinder 5.

A piston rod bushing 24 is mounted within end cap 14 and held therein by retaining ring 26 which snaps into annular groove 28. Seals 30 and 32 prevent the hydraulic or pneumatic fluid from leaking around bushing 24. Attached to piston rod 36, which extends through end cap 14 and bushing 24, is a double acting cylindrical piston 38 provided with annular seals 40 and 42. Piston 38 cooperates with cylinder barrel 10 and end caps 12 and 14 to form a pair of variable volume chambers 44 and 46 on either side thereof. As pressurized air or hydraulic fluid is admitted to and evacuated from chambers 44 and 46 through ports 48 and 50 respectively, piston 38 and piston rod 36 will reciprocate axially. The distal end 52 of piston rod 36 is provided with threads so as to facilitate attachment to the element or mechanism which is to be operated. A splined piston guide rod 54 is received within piston 38 and hollow piston rod 36 and by virtue of complementary female splines in piston 38, the latter is free to slide over guide rod 54 yet relative rotation between piston 38 and guide rod 54 is prevented. By virtue of the rigid connection between piston 38 and piston rod 36, the latter is also constrained to the same angular orientation as guide rod 54.

Guide rod 54 is connected to end cap 12 through guide rod holder 56, which is received within a cylindrical recess 58 coaxially with piston 38 and cylinder barrel 10. Guide rod holder 56 is provided with an axial recess 60 within which reduced end portion 62 of guide rod 54 is received. A pin 64 fixedly extends transversely through portion 62 of guide rod 54 and is received within a slot 66 on the forward end of a guide rod holder 56. This assembly is held together by means of retaining washer 68 and snap ring 70, the latter being disposed with an annular recess 72 in end cap 12. Seal 74 and seal backup ring 76 prevent fluid leakage from cylinder barrel 10.

Figure 4:
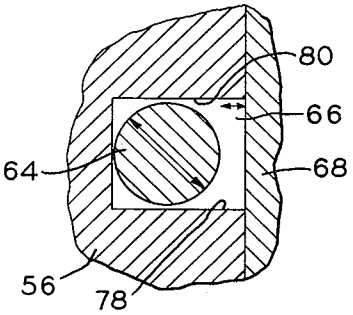
FIG. 4 is a enlarged fragmentary sectional view taken along line 4—4 of FIG. 2 and viewed in the direction of the arrows.
Figure 3:
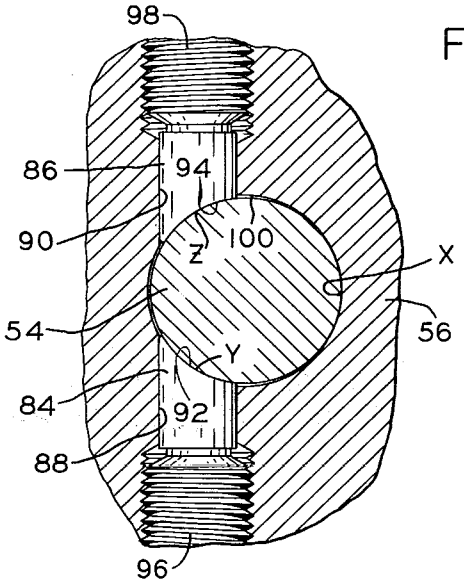
FIG. 3 is an enlarged fragmentary sectional view taken along line 3—3 of FIG. 2 and viewed in the direction of the arrows.
Figure 2:
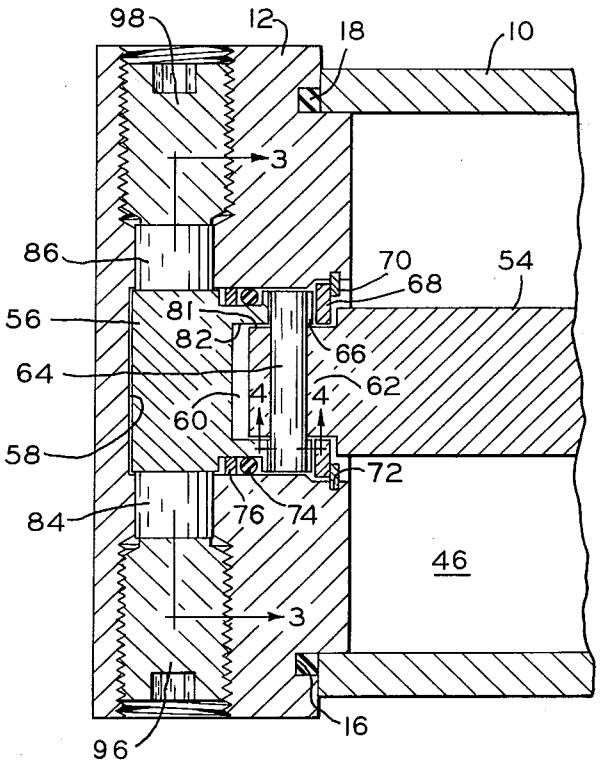
FIG. 2 is a sectional view of FIG. 1 taken along line 2—2 and viewed in the direction of the arrows.

With reference to FIG. 4, it will be seen that clearance between pin 64 and the lateral side walls 78 and 80 of slot 66 is quite small so that there is virtually no freedom of rotation between guide rod 54 and holder 56. There is clearance between pin 64 and retaining washer 68, however, so that guide rod 54 is able to tilt about end 62 to a very limited extent. This tilting may take place about an axis perpendicular to the longitudinal axis of pin 64 and the longitudinal axis of guide rod 54. A limited degree of tilting is also possible around the longitudinal axis of pin 64 by virtue of a slight clearance between the outer surface 81 of reduced portion 62 and the inner surface 82 of recess 60. The capability for guide rod 54 to tilt about these perpendicular axes enables it to tilt about any axis within the plane of pin 64 perpendicular to the longitudinal axis of guide rod 54. Universal tilting is therefore possible to a limited degree.

This construction is advantageous from the standpoint of manufacturing since it compensates for any irregularities, such as eccentricities or angularities or tolerances which are not as close as they would normally have to be. Any binding between the piston 38 and cylinder 10 is greatly reduced thereby increasing the life of the apparatus. For example, a lack of concentricity between the piston 38 or piston rod 36 and the guide rod 54 is compensated for by a slight tilt to guide rod 54 by virtue of the universal connection to guide rod holder 56. In prior art designs where the guide rod is rigidly connected to the end cap, unless the piston, piston rod, guide rod and cylinder are perfectly aligned, the piston would be forced off to one side and bind as it is reciprocated. The present invention permits smooth operation even if this should occur by taking up the misalignment in the universal connection.

In certain applications, it is desirable to adjust the angular orientation of the piston rod 36 and this is accomplished in the present invention by permitting guide rod holder 56 to rotate within recess 58. In order to lock holder 56 and guide rod 54 at the desired position, end cap 12 is provided with a pair of opposing cam lock pins 84 and 86 received within bores 88 and 90 which are offset from the axis of holder 56. Pins 84 and 86 have complementary arcuate surfaces 92 and 94 which are urged into contact with guide rod holder 56 by set screws 96 and 98. As set screws 96 and 98 are tightened, pins 84 and 86 clamp guide rod holder 56 and force it against the surface 100 of recess 58. This results in three point contact at points *x*, *y* and *z* which creates frictional forces sufficient to resist the rotational torque on guide rod 54.

To adjust the angular orientation of piston rod 36, set screws 96 and 98 are loosened thereby permitting relatively free rotation of the entire assembly within cylinder 10 and end caps 12 and 14. Set screws 96 and 98 are then retightened to lock the assembly in the desired position.

A further feature of advantage resides in the capability of rotationally adjusting the guide rod 54 without disrupting the sealed condition of chamber 46. The seal 74 on guide rod holder 56 is disposed inboard of the cam lock pins 84 and 86. Thus, these pins 84 and 86 upon being loosened to permit adjustment of holder 56 do not disturb seal 74, such that leakage from chamber 46 past holder 74 and pins 84, 86 will not occur. Alternatively, seal 74 may be omitted and O-ring seals about pins 84 and 86 added for preventing leakage past the latter during adjustment of holder 56. Thus, rotational adjustment of guide rod 54 in fine or major increments may be accurately achieved by reason of the particular cam lock arrangement, even during the presence of pressurization in chamber 46, without causing leakage past holder 56.

While the invention has been described as having a preferred design, this application is intended to cover any modifications, uses or adaptations which fall within the scope of the invention.

What is claimed is:

1. A fluid power cylinder comprising:

a cylinder barrel, an end cap enclosing one end of said cylinder barrel, a guide rod received within said cylinder barrel, a piston slidably received within said cylinder barrel over said guide rod for rectilinear movement, a piston rod connected to said piston, means for slidably keying said piston to said guide rod whereby said piston is locked against rotation with respect to said guide rod about the longitudinal axis of said guide rod, a guide rod holder rotatably received in said end cap for rotation coaxially with said piston and said guide rod, means for movably connecting said guide rod and guide rod holder so that said guide rod is locked against rotation relative to said guide rod holder but permitting said guide rod and holder to tilt relative to each other, and lock means associated with said end cap for releasably clamping said guide rod holder against rotation.

2. The power cylinder of claim 1 wherein said lock means comprises at least one cam member and means for urging said cam member against said guide rod holder.

3. The power cylinder of claim 1 wherein:

said guide rod holder has a generally cylindrical outer configuration and is received within a circular recess in said end cap, said lock means comprises a lock pin received within a bore in said end cap and threaded means for urging said pin against said guide rod holder.

4. The power cylinder of claim 3 wherein said lock pin has a complementary arcuate surface in contact with said guide rod holder.

5. The power cylinder of claim 3 wherein said lock means includes two said lock pins axially aligned with each other.

6. The power cylinder of claim 5 wherein said lock pins include complementary arcuate surfaces in contact with said guide rod holder.

7. The power cylinder of claim 6 wherein said lock pins are offset from the axis of said guide rod holder.

8. The power cylinder of claim 7 including an O-ring seal interposed between said guide rod holder and said circular recess to inhibit leakage of pressure fluid past said holder, said O-ring seal being further disposed between said lock pins and said piston.

9. The power cylinder of claim 1 wherein said means for connecting comprises a pin passing through said guide rod and means for retaining said pin in said guide rod holder.

10. The power cylinder of claim 9 including a slot in said guide rod holder within which said pin is retained, said guide rod being capable of tilting to a limited degree about the longitudinal axis of said pin and to a limited degree about an axis perpendicular to the longitudinal axis of said pin and perpendicular to the longitudinal axis of said guide rod.

11. The power cylinder of claim 9 wherein said holder has a central cavity that receives with clearance an end portion of said guide rod, said connecting pin being diametrically mounted on said rod end portion with the pin ends projecting therebeyond, said means for retaining said pin in said guide rod holder including a diametral slot in said holder that slidably receives with no clearance said pin ends, respectively, and a retaining washer surrounding said guide rod mounted on said end cap in a position immediately adjacent to said pin ends to thereby overlie the open side of said diametral slot, said pin ends captured in said diametral slot by said retaining washer, said retaining washer with said diametral slot defining a clearance with said pin ends thereby permitting corresponding tilting movement of said guide rod relative to said holder and barrel.

12. The power cylinder of claim 1 including means for sealing against leakage past the guide rod holder.

13. The power cylinder of claim 1 including means for sealing against leakage past said guide rod holder.

14. A fluid power cylinder comprising:

a cylinder barrel, an end cap enclosing one end of said cylinder barrel, a guide rod received in said cylinder barrel, a guide rod holder movably connected to said end cap, means for locking said guide rod holder against rotation with respect to said end cap, means connecting said guide rod and guide rod holder for locking said guide rod and guide rod holder against relative rotation about the longitudinal axis of said guide rod and permitting said guide rod to tilt to a limited degree about axes perpendicular to the longitudinal axis of said guide rod, a piston slidably received within said cylinder over said guide rod and defining with said cylinder barrel and end cap a pressure fluid chamber, an output means connected to said piston, and means for slidably keying said piston to said guide rod whereby said piston is locked against rotation relative to said guide rod about the longitudinal axis of said guide rod.

15. The power cylinder of claim 14 wherein said means connecting said guide rod and guide rod holder includes a pin passing through said guide rod and means for retaining said pin in said guide rod holder.

16. The power cylinder of claim 14 including means for sealing against leakage past said guide rod holder.

17. The power cylinder of claim 14 wherein said locking means includes means manually adjustable for effecting rotational adjustment of said guide rod holder relative to said cylinder barrel, and including means for sealing against leakage from said chamber past said holder and said manually adjustable means.

* * * * *